United States Patent [19]

Cipollone

[11] 4,285,483

[45] Aug. 25, 1981

[54] ELECTRONIC EVENTS RECORDING MEANS

[75] Inventor: John J. Cipollone, San Bernardino, Calif.

[73] Assignee: Electro Pneumatic Corporation, Riverside, Calif.

[21] Appl. No.: 36,347

[22] Filed: May 7, 1979

[51] Int. Cl.[3] ..... B61L 21/00

[52] U.S. Cl. ..... 246/107; 235/92 T

[58] Field of Search ..... 246/107, 185, 123; 346/110, 33 R; 360/6; 235/92 T; 364/900, 550, 551, 569; 340/711, 721, 715, 722, 747

[56] References Cited

U.S. PATENT DOCUMENTS

| | | | |
|---|---|---|---|
| 2,153,675 | 4/1939 | Pflasterer | 246/107 |
| 3,175,125 | 3/1965 | Smith | 246/107 |
| 3,478,202 | 11/1969 | Snodgrass | 246/107 |
| 3,984,815 | 10/1976 | Drexler et al. | 235/92 T X |
| 4,142,680 | 3/1979 | Oswald et al. | 235/92 T X |

*Primary Examiner*—J. D. Miller
*Assistant Examiner*—Reinhard J. Eisenzopf
*Attorney, Agent, or Firm*—John H. Crowe

[57] ABSTRACT

An events-monitoring and recording system for providing at any desired time a tangible record of a large number of several kinds of different events that have occurred randomly over an extended period of time, and in the case of each event further providing an accurate record of the date and time of day at which the individual event occurred. The data of the events are immediately produced and stored for future access as the events occur, without involving any moving mechanisms and with recording of each change of time from AM to PM and from one day to the next, whereby the system is capable of operating faultlessly in extremely adverse environments subject to vibration, heat, cold, particulate and gaseous pollutants and without attention over extended periods of time. Events data are electronically produced in response to receipt of respective electric signals and the data are stored in a circulating type memory of large but finite capacity, whereby when the memory is filled the oldest event information is discarded incident to a new event occurring. Storage is of indefinite duration and the information remains stored and available for accessing at any time by an auxiliary portable print-out device which may be transported to any of a plurality of the monitoring systems at diverse locations.

5 Claims, 7 Drawing Figures

| | | 1234 | 5678 |
|---|---|---|---|
| 2:09:43 | PM | 0000 | 1000 |
| 2:09:45 | PM | 0000 | 0000 |
| 2:14:05 | PM | 0001 | 0000 |
| 2:14:06 | PM | 0000 | 1000 |
| 2:14:08 | PM | 0000 | 0100 |
| 2:14:09 | PM | 0000 | 0000 |
| 4:43:19 | AM | 1000 | 0000 |
| 4:43:21 | AM | 0100 | 0000 |
| 4:43:22 | AM | 0010 | 0000 |
| 4:43:24 | AM | 0001 | 0000 |

ELECTRONIC EVENTS RECORDING MEANS

BACKGROUND OF THE INVENTION

This invention relates generally to an events monitoring and recording system, and more particularly to such a system for use at highway crossings of railroad tracks at which it is desired to have available records of the occurrences, and times of occurrence, of events such as entry of a train into a signal block, commencements and durations of operations of flashing-light and alarm-bell signals, lowering and raising of roadway barriers, and arrival of a train at the crossing and departure therefrom.

It is known to provide a paper-tape printing and perforating means, connected to various relays and detectors disposed along a railway, adapted to produce a printed and punched tape record of data, time, and type of occurrence of events represented by operations of the relays and detectors. Typical of the prior art devices or systems of this character is that disclosed in U.S. Pat. No. 2,153,675 to Pflasterer. Such prior art systems suffered from malfunctions caused by vibrations, heat, cold, dust and moisture when located in conventional signal stands along railroad rights-of-way.

SUMMARY OF THE INVENTION

The present invention avoids the above-mentioned disadvantages of prior art systems for producing printed and perforated tape records of the occurrence of events along railroad rights-of-way by utilizing only solid-state electronic circuitry in hermetically sealed units and solid-state digital memory means for storing data of events as the latter occur and which may be accessed by a multi-contact plug-in type of electronic printing means at any desired time. Thus a physical record of a large number of events that may have occurred at sundry times during an extended period of time may be produced at will by simply plugging in the portable record printing means. A physical record is thus produced only when desired, and is thus available only to authorized personnel having access to a compatible printer and the solid-state events-monitor and memory. Thus, at a typical railroad crossing, it may be desirable to have a physical record of events that occurred following a crossing accident, or only at specified apparatus-test intervals, and at such time the printer may be plugged in to provide a physical printed record of all data relating to the series of events preceding the printout and stored in the memory of the system. In the embodiment of the invention illustrated hereinafter, a memory for storage of records of 256 events is provided, but it is evident that expansion of the memory to any desired capacity is feasible and within the purview of the invention.

From the brief description above, it is evident that a principal object of the invention is to provide an events monitor and information store having no moving parts and capable of storing data relating to any of a plurality of electrically-evidenced events occurring randomly in time.

Another object of the invention is to provide an events monitor capable of continually storing representations of occurrences of events serially in time without producing a tangible record and of automatically discarding information in excess of memory capacity, until any such time as a physical record of occurrences of events is desired.

Another object of the invention is to provide a store of representations of differing events occurring randomly in series in time with automatic discard of representations in excess of the capacity of the store and with capability of immediate production of a physical record of the events having representations in the store at any desired time.

Another object of the invention is to provide a railroad-crossing events monitor and information store having no moving parts and substantially immune to the environmental hazards characteristic of signal stations at railroad crossings.

Other objects, features and advantages of the invention will be evident in the light of subsequent disclosures herein.

DESCRIPTION OF THE PREFERRED EMBODIMENT

Figure 1A:
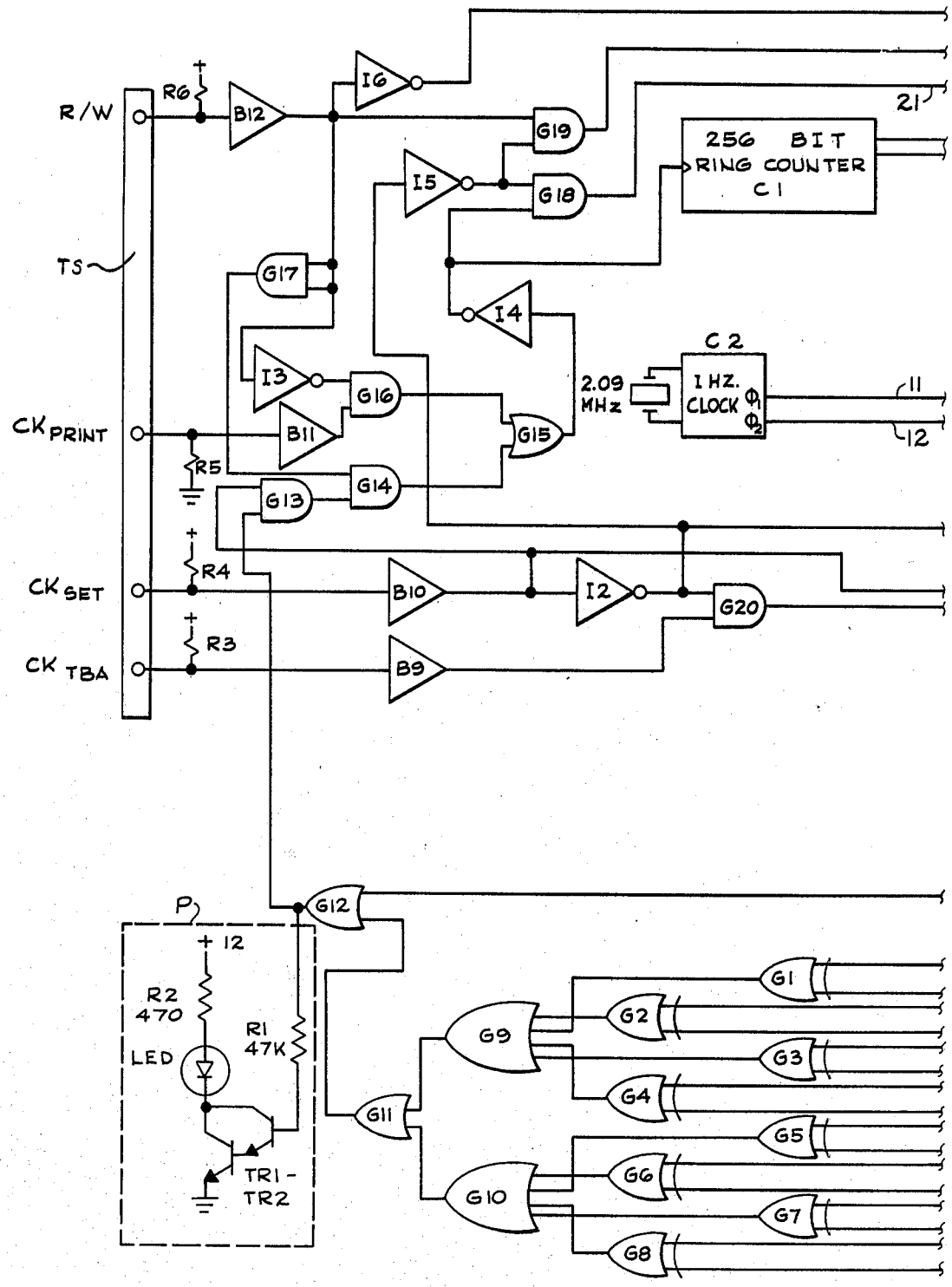
FIGS. 1A, 1B and 1C are complementary portions of a symbolic schematic electronic diagram of exemplary circuitry according to the invention.
Figure 1B:
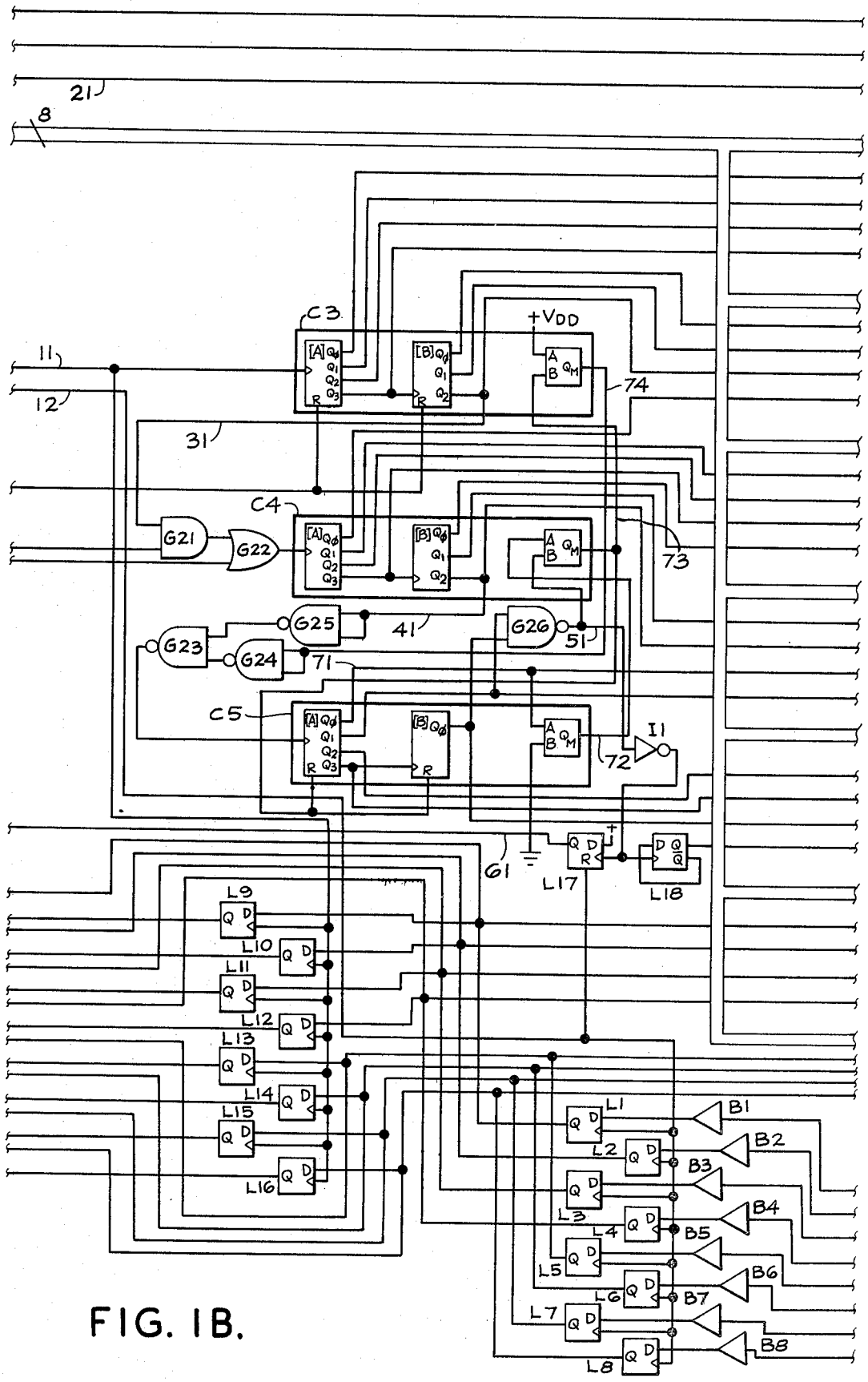
Figure 1C:
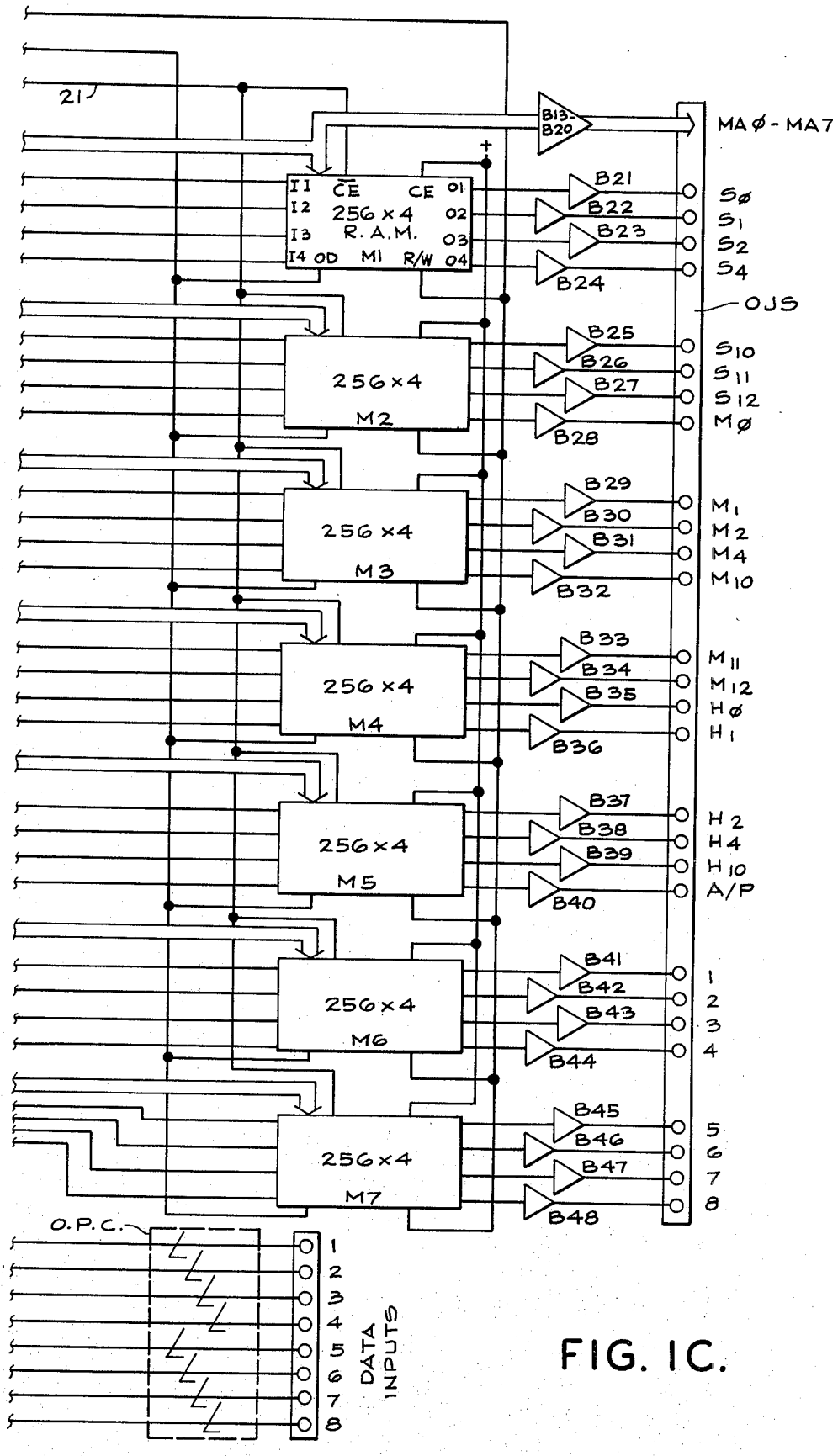

Referring first to FIGS. 1A, 1B and 1C, the illustrated embodiment of the invention is arranged to monitor and provide stored data of eight types of events, each of which is represented by appearance of an electric potential appearing at a respective one of data input terminals 1, 2 - - - 7,8, inclusive (FIG. 1C). The potential thus manifested at any particular terminal is derived as an input signal from closure or other operation of a particular component of existing railway equipment, such as, for example, a crossing-gate operation-initiating relay, the potential-change power being derived from the usual railway signal system power supply or a battery. Each such input signal is current-limited and optically coupled to a separate one of eight individual input buffer stages B1, B2 - - - B8. The optical couplings (O.P.C. on FIG. 1C) isolate the remainder of the circuitry and logical elements from undesired voltage transients including effects of lighting, and serve also to convert an input signal to a potential level appropriate for the following logic elements, and to invert the signals in the logical sense.

An electronic clock C2 (FIG. 1A) having two outputs and operating at a frequency of one hertz is provided for effecting timing of logical operations of the circuitry in processing incoming event-representing signals and operating time-of-day logic and the circulating memory for progressively storing events data as the signals appear at the outputs of the above-noted buffer stages. Thus, clock signals or timing pulses here designated T2 are produced by clock C2 on clock output line 12 at one second intervals, and similar pulses here designated T1 on output line 11, the latter pulses or timing signals following the T2 pulses by 500 milliseconds as indicated on the timing diagram in FIG. 4. Thus, T2 timing signals occur via line 12 at respective timing input terminals of respective data latches L1, L2, - - - L8, each of which also has an event-data input terminal connected to the output of a respective one of the aforementioned buffers B1, B2 - - - B8, as indicated in FIG. 1B.

Outputs from latches L1, L2 - - - L8 are directed to data input terminals of respective ones of latches L9, L10 - - - L16, and also to respective input lines of memory units M6 and M7, as indicated in FIGS. 1A and 1B. Latches L9, L10 - - - L16 also receive clock pulses T1 via connections to clock output line 11 as indicated. Output lines of latches L1, L2 - - - L8 are also connected to respective input terminals of respective exclusive OR gates G1, G2 - - - G8, as indicated.

Thus recording in the memory of occurrence of an event on, for example, signal input terminal 1, is illustrated on the timing diagrams (FIGS. 3 and 4) as occurring during the interval from time A to time B. The change of potential (signal) at input terminal 1 is translated through buffer B1 to the data input terminal of latch L1, and the data represented by the signal is transferred to the memory input at the rise of the next clock pulse T2. This also produces a change in the inputs to gate G1 which results in a logical one output from the latter. The rising edge of the next clock pulse T1 transfers the data signal through latch L9 which thus equalizes the inputs to gate G1 to produce a logical zero output from G1. Thus a one-half second pulse is produced which is passed through gates G9, G11 and G12. Potentials for selectively activating logical gate circuitry are provided at a terminal strip TS (FIG. 1A) at terminals R/W, $CK_{PRINT}$, $CK_{SET}$, $CK_{TBA}$, and via an electronic network P (FIG. 1A), as indicated. Clock C2 is a crystal-controlled conventional battery-powered unit operating by frequency-division to provide pulse outputs of 1 Hz frequency. Counting chain digital counters C3, C4 and C5, receiving input timing pulses from clock C2 via a branch from lead 11, provide measurement of real time which is supplied to memory units M1 through M5 in BCD form. With control inputs unterminated, the one-half second pulse from G12 passes through gates G13, G14 and G15 which are connected as indicated to the input of inverter I4. The leading edge of the one-half second pulse out from I4 causes the input to gate G18 to go to logical zero ($\phi$), which in turn via lead 21 causes the $\overline{CE}$ input to Random Access Memory (RAM) unit M1 to go to $\phi$, enabling the memory (units M1 through M7). The memory is otherwise in the WRITE mode (CE=1, OD=1, R/W=$\phi$), and hence the signal data is recorded or written into the memory, along with the BCD representation of the time of day from counters C3, C4, and C5 and latch L18.

The trailing edge of the noted half-second pulse output from latch G12, acting by way of latch G18 and lead 21, disables the memory and steps or increments the 256 bit ring counter C1.

Each of counters C3, C4 and C5 comprises a divide-by-ten counter, a divide-by-six counter and a microsecond one-shot circuit. Clock pulses T1 from clock C2 on lead 11 step or increment the "A" section of counter C3 once each second during the trailing edge of the T1 pulse. The trailing edge of the Q3 output from section "A" of counter C3 steps or increments the "B" section of counter C3. The seven outputs from counter C3 thus count to 60 in binary decimal code (BCD). The Q2 output from section "B" of counter C3 steps counter C4 via lead 31 and gates G21 and G22. The Q2 output from section "B" of counter C4 steps or increments counter C5 via lead 41 and gates G23, G24 and G25. Acting with the latter three gates and the one-shot sections of counters C3, C4 and C5, counter C5 effects a divide-by-twelve operation. Thus twelve-hour periods are counted off, and designation of the time of occurrence of an event may be specific as to the A.M. or P.M. portion of the calendar day. The change or transition from A.M. to P.M. at 12:00 noon is illustrated on the timing diagram between times B and C.

In the timing diagram the usual convention is adhered to, a voltage "high" representing a logical "one" (1) state and a low or zero potential representing a logical zero ($\phi$) state. As the A.M. half-day expires and the P.M. half-day commences, as noted on the timing chart from B to C, the output of gate G26 goes to logical zero state at 12:00 noon, and that, by way of inverter I1 in G26 output lead 51, clocks latches L17 and L18. Latch L18 divides by two to provide an indication of A.M. or P.M. Latch L17 produces an output signal on its Q output that is reset at the leading edge of the timing clock pulse T2 which occurs shortly after the mid-time of period B-C as indicated on the timing diagram. That results in production of a 468 msec pulse on the Q output line of latch L17 which via lead 61 is summed through gate G12 to store a record of the event in the memory.

Illustratively, the transition from 12:59:59 A.M. to 1:00:00 A.M. is shown as occurring from C to D on the timing diagram. The rising edge of the output at Q$\phi$ of section A of counter C5 triggers the one-shot of that counter, via lead 71, which in turn triggers the one-shot in counter C4 via lead 72 if line 51 is logical $\phi$. The QM output of the latter one-shot in turn resets counter C5 to zero and triggers the one-shot of counter C3 via lead 73. The output at QM of the one-shot of counter C3, via lead 74 and gates G23 and G24, steps or increments counter C5, and thus the output of C5 progresses from 12 to 1, producing the effect of counting from 12:59:59 to 1:00:00. An event is indicated on the timing diagram as being recorded at 1:00:00 A.M., during the interval C-D.

Figure 3:
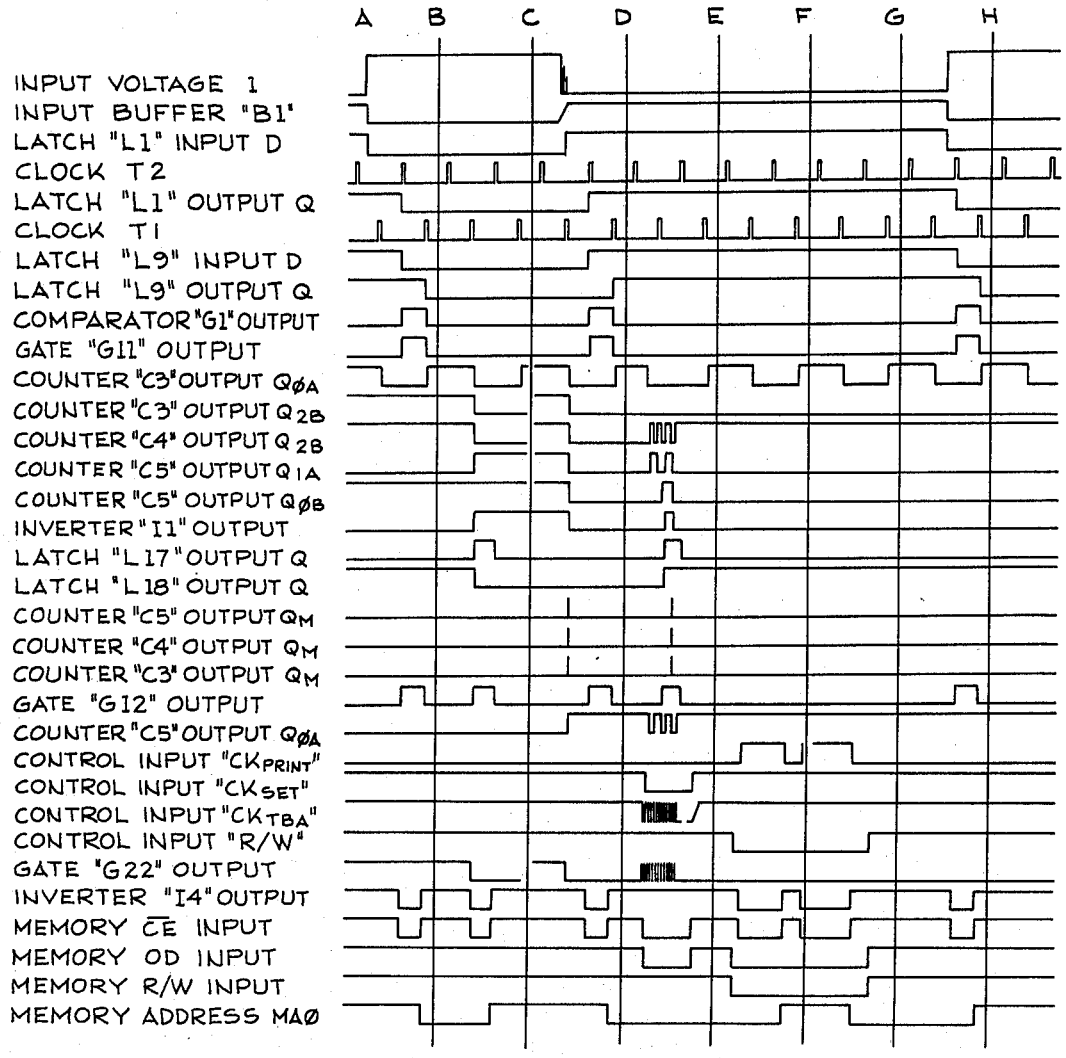
FIG. 3 is a diagram depicting time relationships of first and second alternating clock signals and the functioning of various components during a variety of phases of operations of the monitor circuitry.

Actual current time-of-the-day can be set up in the counters C3, C4 and C5 by activating the control inputs "$CK_{SET}$" and "$CK_{TBA}$" on the terminal strip TS (FIG. 1A), while concurrently sampling (by a portable plug-in printer such as that listed in the components list set out hereinafter), the recorded data in evidence at terminals $M_\phi$, $M_1$, $M_2$, - - - $H_2$, $H_4$, $H_{10}$ and A/P of the output jack strip OJS (FIG. 1C). This time-setting operation is schematically depicted in the interval D-E on the timing diagram (FIG. 3). Triggering the $CK_{SET}$ terminal on strip TS to the logical $\phi$ status disables gate G13 via latch B10, gates G18 and G19 via inverters I2 and I5 and gate G21 via latch B10, and enables gate G20. Thus counter C3 is re-set. By disabling gate G13, entry of data during the time-of-day resetting is prevented. Disabling gates G18 and G19 as noted places memory units M1 through M7 in an open or transparent status whereby events data inputs (D.I.1 through D.I.4) are directed directly to data outputs D.O.1 through D.O.4.

This permits sampling the outputs of counters C3, C4 and C5 through output terminals $S_\phi$, $S_1$, - - - $H_{10}$, A/P on the output jack strip OJS, using the above-mentioned printer, following setting of the actual time-of-day in the printer, in BCD form, by rotation of the thumbwheel switches. Pulsing the $CK_{TBA}$ terminal on strip TS causes counter C4 to be incremented, and with the printer plugged into output jack strip OJS, the events set forth below occur. During the time-setting operation in counters C3, C4 and C5 their progressing outputs are compared with that set up in the printer. A "TIME SET" switch on the printer holds the logical input at $CK_{SET}$ low and starts a 10 KHZ chopper with input at terminal $CK_{TBA}$ on terminal strip TS (FIG. 1A). Thus the outputs at terminals $M_1$ - - - A/P on jack strip OJS very rapidly progress through serial time (BCD) indications until the latter agree with those set up by the thumbwheel switches, the progression requiring a time period of the order of one second or less. The chopper is instantly stopped and an indicator light on the printer lights. The "TIME SET" switch on the printer is then released, which terminates the $CK_{SET}$ input from the printer to terminal $CK_{SET}$, thus starting counter C3 and returning the monitoring circuitry to normal operation for receiving and storing events data. On the timing chart, section or period D-E, the time at D has been arbitrarily chosen at 1:20:01 A.M. and that at E set as 1:50:00 P.M.

Figures 4, 5:
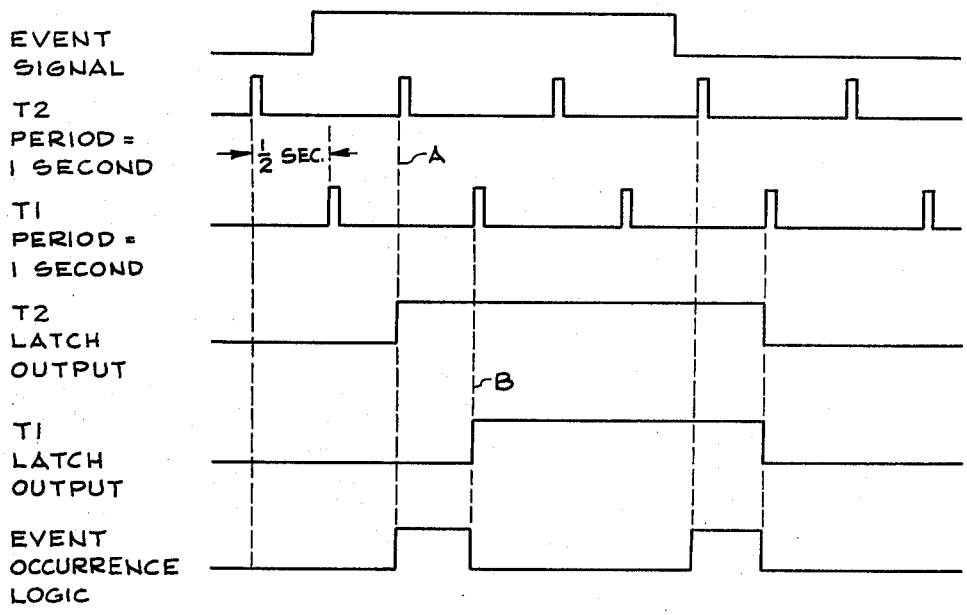
FIG. 4 is an auxiliary timing diagram showing temporal spacing of clock signals and latch operations, relative to an event occurrence or data input signal.
FIG. 5 is a facsimile of fragments of a printer tape showing information derived from the monitor memory in response to accessing of the memory by means of a portable printer.

Events data or information received at the DATA INPUTS terminals 1–8 and stored in the memory unit as previously described is printed out by the aforesaid printer, in the form of a tape, an example of which is shown broken into several significant sections in FIG. 5. The sequence of operations during print-out by the printer is illustrated in sections E to G of the timing diagram (FIG. 3). The first line of printing is diagrammed in section E-F, and the last line of print diagrammed in section F-G. In the case of the exemplary memory herein illustrated and described, 256 lines of data may be stored, each line comprising a representation of the time of day (hour, minute and second) at which an event occurred, whether the time was A.M. or P.M., and eight characters, either a logical one (1) or a logical zero ($\phi$) representing, in the case of each character, either an event input or lack of such input on the respective one of data input terminals 1–8. Thus a typical line of stored data, when subsequently printed by the printer might read:

10:28:13 PM $\phi 11\phi 1\phi\phi 1$, indicating that at the time indicated, a high potential signal was apparent on each of data input terminals 2, 3, 5 and 8, and a low or zero potential (no event) signal apparent on each of input terminals 1, 4, 6 and 7. Obviously it is a matter of circuit designer's choice which logical symbol is chosen to represent a particular type of potential signal, since inverters and like circuit means are available and well known for conversion of one to the other. In this exemplary embodiment of the invention, the presence of a potential, exemplified for instance by closure of a pair of relay contacts, has been chosen to be represented by a logical one (1).

Figure 2:
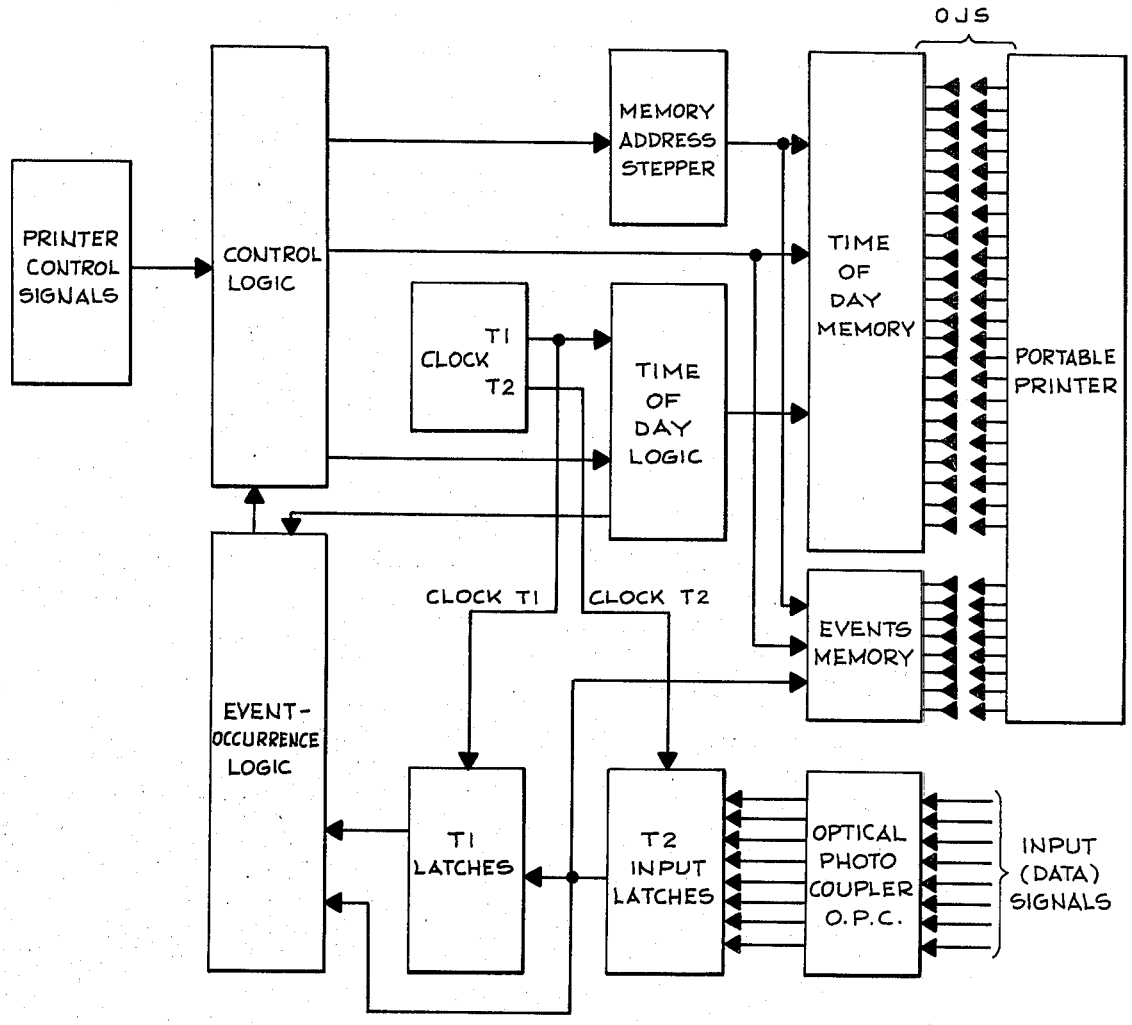
FIG. 2 is a simplified schematic block diagram illustrating the organization of principal units of the circuitry comprising the exemplary embodiment of the invention.

The preceding description and explanation makes it evident that the present monitor and recording device is adapted to monitor and store data of events occurring at random times of the day and night and concurrently store information concerning which of a plurality of different kinds of events have occurred and their respective times of occurrence. Typical examples of such events are: entry of a railroad train into a signal block, commencement of flashing light signals at a highway crossing in the block, lowering of crossing barriers or gates at the crossing, commencement of ringing of warning bells at the barriers, entry of a train into the crossing area, departure of the train from the crossing area, cessation of audible and visual alarm signaling, and raising of crossing barriers. Each such event is evidenced, by way of conventional railway crossing signals, by appearance of a voltage at a respective one of the signal input terminals of the device. When such a potential change occurs at a terminal, the signal it represents is optically-electronically translated by the OPC unit (FIG. 2) to the respective T2 input latch (L1–L8, FIG. 1B) at the rise of a T2 clock pulse (A, FIG. 4), supplied via lead 12 from the clock C2. The L1 - - - L8 latches may act as bistable flip-flops. The output signal from the activated T2 latch is translated into a memory cell in one of memory units M6–M7, and also to the input of a respective latch of T1-triggered latches L9 - - - L16 (FIG. 1B), which latches are pulsed to receive the translated signal at the rise of the T1 clock pulse (B, FIG. 4). Thus the translated signal is transferred to the event-occurrence logical circuitry (FIG. 2) including the "exclusive OR" gates G1 - - - G8 (FIG. 1A) to which the output lines of the L1 - - - L8 gates are also connected. Thus in absence of an input data signal the event-occurrence logical circuitry remains passive, but acts upon translation of a signal through the T1 and T2 clocked latches to create a pulse commencing with the T2 latch output and ending with the T1 latch output (A to B, FIG. 4). That pulse proceeds from the event-occurrence logical circuitry to the control-logic circuitry via gates G11 and G12 (FIG. 1A) and thereby causes the memory units M1, M2, - - - M7 to be enabled via line 21 from gate G18, thus storing the time-of-day from counters C3, C4, C5 and latch L18, and the data from the output lines of L1 - - - L8 latches. The trailing edge of that same pulse then causes the memory address stepper (FIG. 2) to advance the memory units one step. Thus the data or information that was recorded in the "events memory" and "time-of-day memory" units is advanced one memory cell preparatory to reception and recording of the next event to be evidenced by an incoming input-data signal. Thus, as indicated in FIG. 3, the several circuitry units, clocked as noted by the T2 and T1 outputs of clock C2, act to store the data represented by an event-signal, the BCD representation of the time of the day at which the event occurred, and the A.M. or P.M. time of the occurrence. The entire operation is performed by low-power solid-state electronics circuitry which is immune to adverse environmental factors such as heat, cold, dust, moisture, and severe vibration, and which has no moving parts and may be left along in operating condition for indefinitely long periods of time. If or when the memory unit becomes "filled" with recorded events-data, the earliest entry is discarded as a new one is stored, the former being merely displaced or removed from the last cells of the memory incident to insertion of the latter.

If or when it becomes desirable to produce a tangible record of the data or information stored in the memory, a portable printer of the characteristics of that listed in the following exemplary parts list is plugged into the memory output plug board OJS and the $CK_{PRINT}$ control activated, whereupon in a very brief period a printed tape, illustrated in fragmentary form in FIG. 5, is produced by the printer. The printed tape contains the times of occurrence of the 256 preceding events, and an indication of which event occurred at each recorded time. In the illustrative tape or print out in FIG. 5, the symbol "$\phi$" indicates lack or absence of an event-representing signal and the symbol "1" indicates existence of an-event representing signal, at the time designated, the eight columns of symbols each corresponding to a respective one of the input-signal terminals 1, 2 - - - 7, 8 of FIG. 1C.

The following table sets forth a list of commercially available components which I have found particularly suitable for use in the events-monitoring and recording circuitry of this invention as exemplified by the diagram of FIGS. 1A, 1B and 1C.

| Component | Manufacturer | Identification (by part number or rating) |
|---|---|---|
| O.P.C | General Electric | H15B1 |
| B1–B48 | Motorola | MC14050BAL |
| G1–G8 | " | MC14070BAL |
| G9, G10 | " | MC14072BAL |
| G11, G12, G15, G22 | " | MC14071BAL |
| G13, G14, G16, G17 | " | MC14081BAL |
| G18, G19, G20, G21 | " | MC14081BAL |
| G23–G26 | " | MC14011BAL |
| TR1, TR2 | " | 2N2222A |
| I1–I6 | " | MC14049UBL |
| C1 | " | MC14520BAL |
| C2 | R.C.A | CD4045BF |
| C3, C4, C5 | Motorola | MC14566BAL |
| M1–M7 | " | MCM145101L-8 |
| Printer | Electro Pneumatic Corp. (Riverside,CA) | PR-1A |
| L1–L18 | Motorola | MC14013BAL |
| R1 | Allen-Bradley | ¼W, 47K resistor |
| R2 | " | ¼W, 470K resistor |
| R3–R6 | " | ¼W, 4.7K resistor |

While the events-monitoring and recording means of this invention has been herein illustrated and described in what is believed to be a preferred embodiment, it should be understood that the invention is not so limited and can exist in any form encompassed by the language of the following claims. Moreover, the invention is not limited in use to that disclosed herein but can be employed in any capacity and for any purpose consistent with its inherent capabilities.

I claim:

1. An events-monitoring and event-data storing device comprising:

a plurality of electric signal input lines for receiving respective event-representing electric signals;

clock means for providing a first series of electric timing pulses and a second series of such pulses each following in time a pulse of said first series;

a first series of logical latches each connected to a respective one of said signal input lines and to said clock means to pass a clocked input signal in response to a pulse of the first series of pulses and a coincident signal on a respective one of said input lines;

memory means including a series of memory units connected to said latches to receive and record clocked input signals from respective ones of said latches;

a second series of latches each connected to said clock means to receive and pass a signal passed from a respective one of said first series of latches in response to a coincident pulse of the second series of electric timing pulses;

means to provide a continuing series of signals representing current time of day information; and logical circuit means responsive to a signal passed by any of said second series of latches to cause recording in said memory means of the time-of-the-day concurrently with the recording of any passed input signal;

whereby throughout an indefinitely extended period of time any event-representing electric signal received on any of said signal input lines is individually recorded in said memory means concurrently with a record of the time of occurrence of the respective event.

2. A device as set forth in claim 1 in which said memory serves to successively store a time-dispersed series of representations of randomly-occurring event-representing signals and corresponding representations of the time-of-day when the events giving rise to the signals occurred.

3. A device as set forth in claim 2, including means for printing a record of the signal-representations and respective times of occurrence of the events whose representative signals are stored in said memory means.

4. A solid-state electronic railway crossing events monitoring and events-data storing device comprising:

a plurality of electric-signal input lines on each of which is received a respective electric signal representing occurrence of a respective event related to one of a plurality of different crossing events;

clock means for providing a first series of electric timing pulses and a second series of timing pulses each following in time a pulse of the first series;

a first series of logical latches each connected to a respective one of said signal input lines and to said clock means to pass a clocked input signal in response to a pulse of the first series of pulses and a coincident signal on a respective one of said input lines;

memory means including a series of memory units connected to said latches to receive and record clocked input signals from respective ones of said latches;

a second series of latches each connected to said clock means to receive and pass a signal passed from a respective one of said first series of latches in response to a coincident pulse of the second series of electric timing pulses;

means to provide a continuing series of signals representing current time of day information; and logical circuit means responsive to a signal passed by any of said second series of latches to cause recording in said memory means of the time-of-the-day concurrently with the recording of any passed input signal;

whereby throughout an indefinitely extended period of time any event-representing electric signal received on any of said signal input lines is individually recorded in said memory means concurrently with a record of the time of occurrence of the respective event.

5. A solid-state hermetically sealed railway crossing events monitoring and events-data storing device comprising:

a plurality of electric-signal input lines on each of which is received a respective electric signal representing occurrence of a respective event related to one of a plurality of different crossing events;

clock means for providing a first series of electric timing pulses and a second series of timing pulses each following in time a pulse of the first series;

a plurality of optical-coupling means each connected in a respective one of said electric-signal input lines;

a first series of logical latches each connected to a respective one of said optical-coupling means to receive therethrough an event-representing signal occurring on the respective signal input line, said latches each being connected to said clock means to pass a clocked input signal in response to a pulse of the first series of pulses and a coincident signal on a respective one of said input lines;

memory means including a series of memory units connected to said latches to receive and record clocked input signals from respective ones of said latches;

a second series of latches each connected to said clock means to receive and pass a signal passed from a respective one of said first series of latches in response to a coincident pulse of the second series of electric timing pulses;

means to provide a continuing series of signals representing current time of day information; and logical circuit means responsive to a signal passed by any of said second series of latches to cause recording in said memory means of the time-of-the-day concurrently with the recording of any passed input signal;

whereby throughout an indefinitely extended period of time any event-representing electric signal received on any of said signal input lines is individually recorded in said memory means concurrently with a record of the time of occurrence of the respective event; and whereby a plurality of contemporaneous event-representing signals not in excess of the number of said input lines can be concurrently recorded in said memory means at any time during said extended period of time without external attention and irrespective of adverse external environmental effects including vibration, atmospheric contaminents and disturbances, and extremes of temperature.

* * * * *